US008425025B2

(12) United States Patent
Masunaga

(10) Patent No.: US 8,425,025 B2
(45) Date of Patent: Apr. 23, 2013

(54) LIQUID SUPPLY DEVICE AND IMAGE FORMING APPARATUS

(75) Inventor: Suguru Masunaga, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 190 days.

(21) Appl. No.: 12/975,670

(22) Filed: Dec. 22, 2010

(65) Prior Publication Data

US 2011/0164077 A1 Jul. 7, 2011

(30) Foreign Application Priority Data

Jan. 7, 2010 (JP) ..... 2010-001964

(51) Int. Cl.
*B41J 2/17* (2006.01)

(52) U.S. Cl.
USPC ..... 347/94; 347/6; 347/93

(58) Field of Classification Search ..... 347/6, 94
See application file for complete search history.

(56) References Cited

U.S. PATENT DOCUMENTS 4,575,738 A * 3/1986 Sheufelt et al. ..... 347/94
4,624,625 A * 11/1986 Schrenker ..... 417/20
6,470,744 B1 * 10/2002 Usui et al. ..... 73/290 R
6,805,437 B2 * 10/2004 Yamanaka et al. ..... 347/92
7,387,377 B2 6/2008 Yoshino et al.
2011/0050794 A1 * 3/2011 Koike et al. ..... 347/22

FOREIGN PATENT DOCUMENTS

JP 2000-158668 6/2000
JP 2005-96404 4/2005
JP 2008-143027 6/2008

* cited by examiner

*Primary Examiner* — Manish S Shah
*Assistant Examiner* — Jeffrey C Morgan
(74) *Attorney, Agent, or Firm* — Cooper & Dunham LLP

(57) ABSTRACT

A sub tank receives ink supplied from a main tank through a supply path. The sub tank includes a supply chamber that causes the ink to move toward a nozzle, and a pressure control chamber connected to the supply chamber through a connection part that can open/close. The pressure control chamber includes a pressure resistor that reduces the speed of the ink when the ink pressure rises in the supply path, and a volume changing member that is provided on at least a side of the connection part with respect to the pressure resistor in the ink flow direction, so that pressure in the pressure control chamber can be reduced by reducing the ink speed and increasing the volume of the pressure control chamber.

10 Claims, 12 Drawing Sheets

LIQUID SUPPLY DEVICE AND IMAGE FORMING APPARATUS

BACKGROUND OF THE INVENTION

1. Field of the Invention

The present invention relates to a liquid supply device and an image forming apparatus, and more particularly to a structure of a sub tank used in a liquid supply device installed in an inkjet recording device.

2. Description of the Related Art

Conventionally, there is an inkjet recording device among image forming apparatuses such as a printer, a fax machine, a copier, and a plotter. In the inkjet recording device, a low-volume sub tank (liquid container) for supplying ink (liquid) to an inkjet head (liquid jet head) is provided on a carriage, and a high-volume ink cartridge (main tank/liquid storing tank) is provided in the main body of the inkjet recording device. Accordingly, the sub tank is replenished with ink supplied from the main body.

In the above configuration using a sub tank, there is no need to install a large ink tank on the carriage, and therefore when the carriage is moved, the kinetic load for driving the carriage can be reduced and the carriage can be prevented from oscillating.

The ink (liquid) in the main tank is supplied to the sub tank with the use of predetermined pressure. The inside of the sub tank has a negative pressure tendency so that ink is prevented from needlessly flowing to the nozzles. Accordingly, the ink is prevented from needlessly flowing to the head, so that liquid is prevented from dropping out.

FIGS. 10A and 10B illustrate a mechanism for supplying ink to a sub tank having a negative pressure tendency, which is disclosed in patent document 1.

As shown in FIGS. 10A and 10B, the negative pressure in a negative pressure chamber 101 in a sub tank 100 is generated as a flexible member such as a film 102 is expanded outward by a spring 103. Specifically, the spring 103 does not directly push the film 102, but rather, the spring 103 pushes a disk-type sheet 104 that is welded to the film 102 for the purpose of reinforcing the film 102.

At a position facing the disk-type sheet 104 across the film 102, a force is generated at a point of effort 108A of a lever member 108. A valve member 105 is provided at a point of load 108B. The valve member 105 is operated via a fulcrum 108C to open an ink injection part 100A. Accordingly, the ink in a supply path connected to the main tank is supplied to the negative pressure chamber 101. The valve opening pressure of the valve member 105 is set to a static pressure by a spring 107.

The above configuration uses the function of a lever, and therefore it is possible to generate a force that is greater than or equal to the pressure-receiving area of the film 102.

There is proposed a mechanism for preventing the oscillation of a film in a structure using the film. Specifically, flexible films and resin plates that are integrally combined with the flexible films are used as walls of the sub tank. Accordingly, the oscillation of the flexible film can be mitigated by the resin plates (see, for example, patent document 2).

In a configuration in which the sub tank and the ink tank are placed at different positions, and the sub tank and the ink tank are connected by a tube, the following problem may arise. That is, as the main scanning width increases, the length of the tube needs to be increased. Accordingly, inertia occurs when the speed of the carriage is increased or decreased. Due to this inertia, the ink moves, and the liquid pressure changes from a predetermined pressure. Changes in the liquid pressure affect the negative pressure tendency in the sub tank. Consequently, the liquid ink may needlessly drop out from the head.

Patent Document 1: Japanese Laid-Open Patent Application No. 2005-096404

Patent Document 2: Japanese Laid-Open Patent Application No. 2008-143027

SUMMARY OF THE INVENTION

The present invention provides a liquid supply device and an image forming apparatus, in which one or more of the above-described disadvantages are eliminated.

A preferred embodiment of the present invention provides a liquid supply device and an image forming apparatus with which liquid can be prevented from dropping out due to changes in the liquid pressure in a liquid supply path caused by inertia.

According to an aspect of the present invention, there is provided a liquid supply device including a main tank that stores a recording liquid; a sub tank that is connected to the main tank via a supply path; and a nozzle that jets the recording liquid retained in the sub tank, wherein the recording liquid is supplied into the sub tank from the main tank by a predetermined pressure, and the sub tank includes a supply chamber that causes the recording liquid to move toward the nozzle, the supply chamber including an opening/closing valve provided at an injection part through which the recording liquid enters the supply chamber from the main tank, and a pressure control chamber that supplies the recording liquid from the main tank into the supply chamber, the pressure control chamber being connected to the supply path, wherein the pressure control chamber includes a pressure resistor having a filter function provided near a connection part between the pressure control chamber and the supply chamber, the pressure resistor being placed in such a manner as to extend across a flow direction of the recording liquid, and a pressure mitigating unit provided on a wall of the pressure control chamber near the connection part, on at least a downstream side with respect to the pressure resistor in the flow direction of the recording liquid, wherein the pressure mitigating unit changes a volume of the pressure control chamber in accordance with a change in a liquid pressure that has occurred in the supply path, to mitigate an impact of the changed liquid pressure applied on the connection part.

According to one embodiment of the present invention, a liquid supply device and an image forming apparatus are provided, in which increased pressure can be reduced to static pressure with a simple configuration including a volume changing member that only uses pressure changes in the pressure control chamber and a speed reduction mechanism, so that the liquid can be reliably prevented from dropping out due to changes in the pressure.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description is given, with reference to the accompanying drawings, of embodiments of the present invention.

Figure 1:
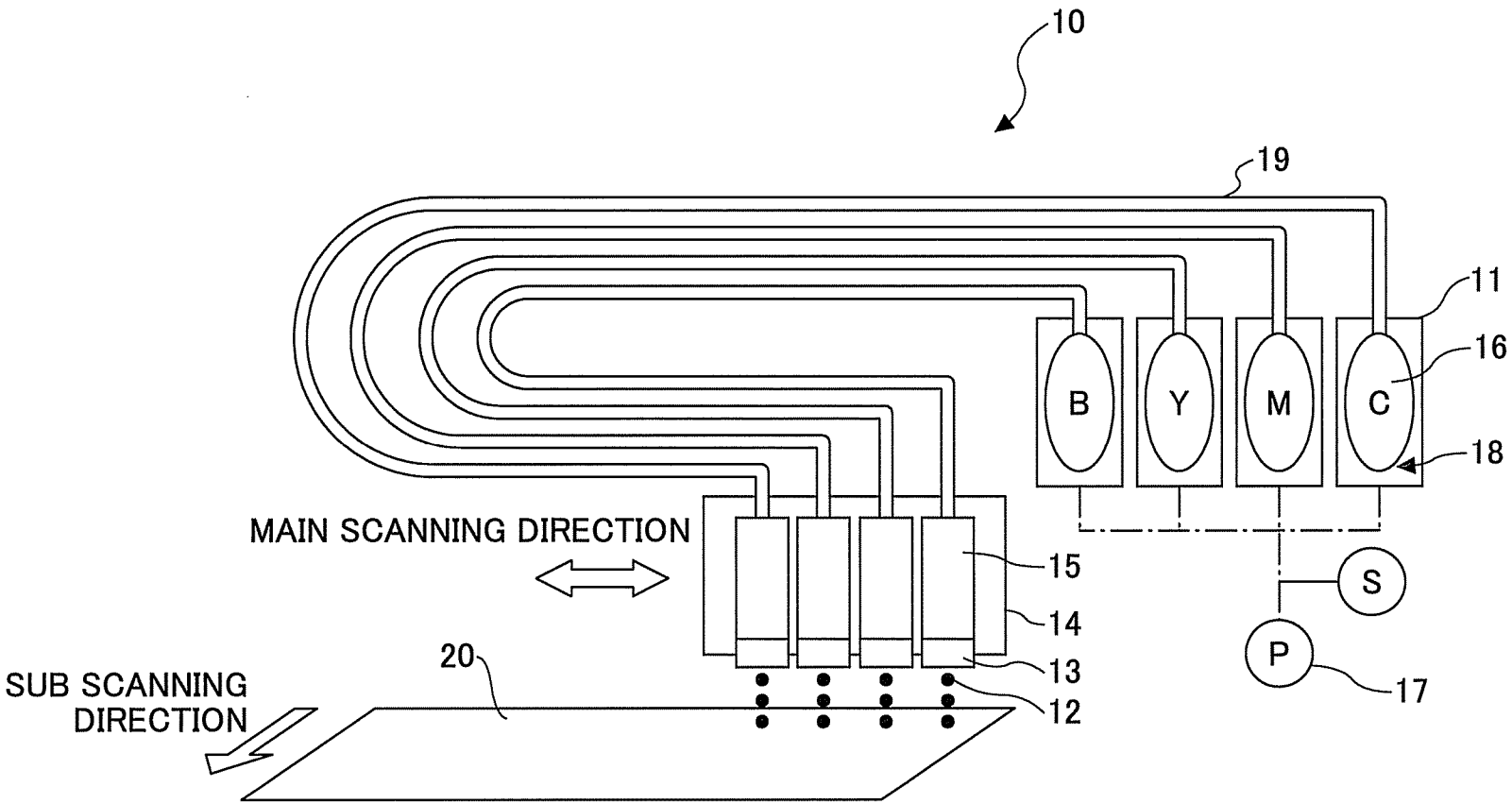
FIG. 1 is a schematic diagram of a liquid supply device according to an embodiment of the present invention used in an image forming apparatus.

FIG. 1 illustrates a case where a liquid supply device is used in an inkjet recording device 10 that is an image forming apparatus.

The inkjet recording device 10 includes recording heads 13 that jet ink droplets 12. The ink droplets 12 are formed with ink supplied from ink cartridges 11 corresponding to different colors. Furthermore, the inkjet recording device 10 includes a carriage 14 equipped with the recording heads 13. The carriage 14 moves back and forth above a recording sheet 20.

Sub tanks 15 are integrally combined with the recording heads 13, for supplying ink to the recording heads 13. The ink cartridges 11 corresponding to main tanks are placed at positions away from the carriage 14. A pump 17 is used to apply pressure to air chambers 18, so that ink in ink packs 16 of the ink cartridges 11 is supplied to the sub tanks 15 through supply paths such as tubes 19.

The reason why pressure is used to assist the ink to be supplied is to prevent supply failures. Specifically, the longer the supply path, the larger the flow path resistance, and consequently the ink may not be properly supplied (supply failure). In accordance with image information, the recording sheet 20 is intermittently conveyed in the sub scanning direction, while the recording heads 13 installed in the carriage 14 move back and forth in the main scanning direction above the recording sheet 20 and jet the ink droplets 12, so that an image is formed on the recording sheet 20.

Figure 2B:
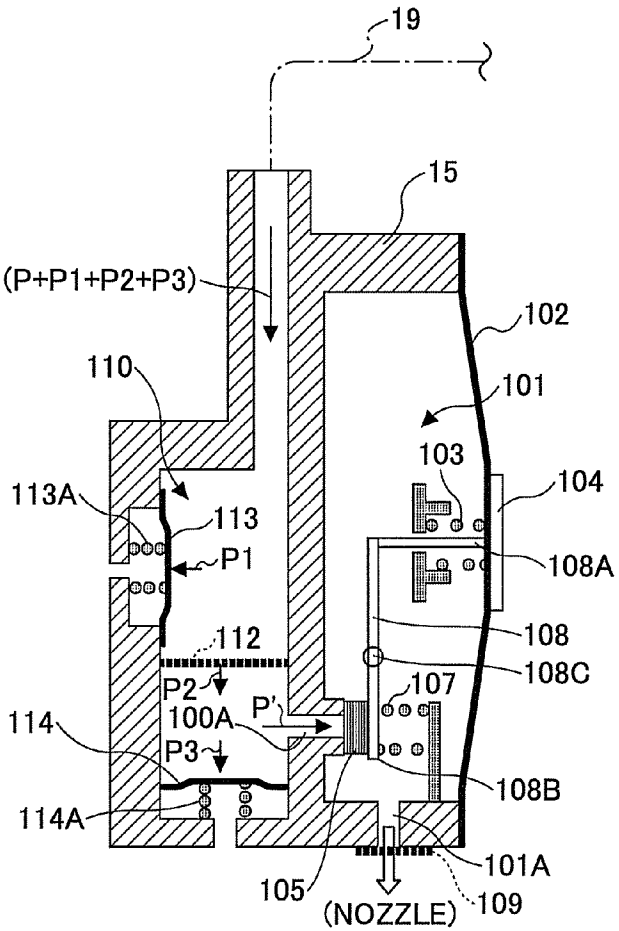
FIGS. 2A and 2B are for describing relevant parts of the liquid supply device according to an embodiment of the present invention.
Figure 2A:
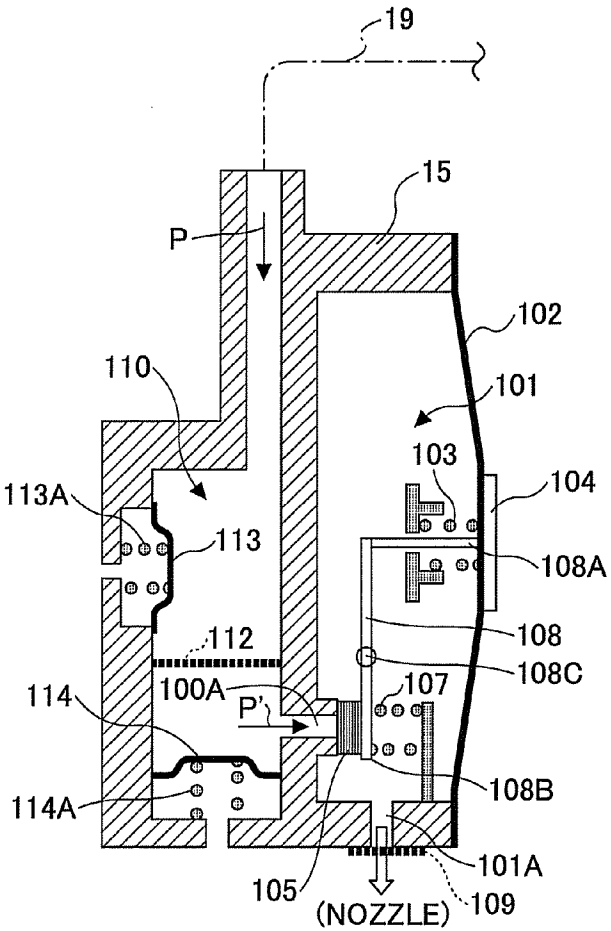

FIGS. 2A and 2B illustrate the inside of the sub tank 15. In FIGS. 2A and 2B, the same elements as those shown in FIG. 1 are denoted by the same reference numerals.

Figure 10B:
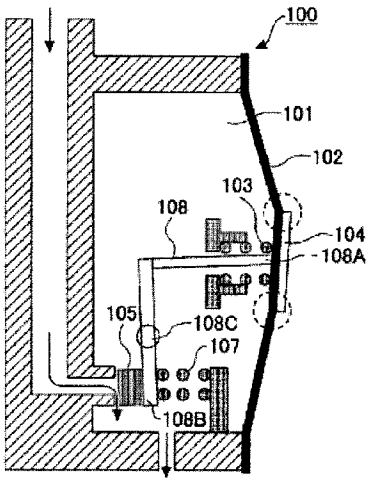
FIG.10B (Prior Art)
FIGS. 10A and 10B illustrate a sub tank used in a conventional liquid display device.
Figure 10A:
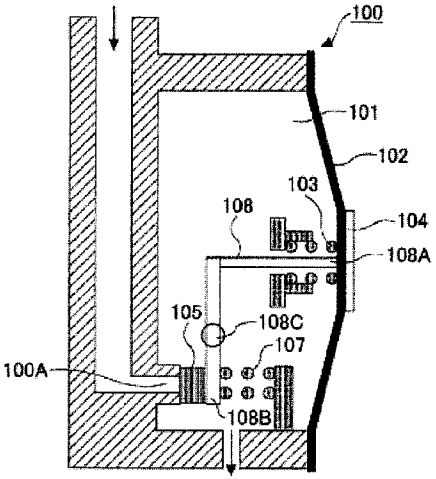
FIG.10A (Prior Art)

As shown in FIGS. 2A and 2B, the sub tank 15 includes a negative pressure chamber 101 having a similar configuration as that in FIGS. 10A and 10B, and a pressure control chamber 110 having a space connected to the tube 19 acting as an ink supply path connected to the ink cartridge 11.

The volume of the negative pressure chamber 101 contracts as the film 102 is displaced due to negative pressure generated in the nozzle. Accordingly, ink is supplied toward the nozzle from a supply opening 101A connected to the nozzle. Thus, the negative pressure chamber 101 acts as a supply chamber for supplying ink to the nozzle. In FIGS. 2A and 2B, a reference numeral 109 denotes a filter for preventing foreign matter from entering the nozzle. The filter 109 covers the supply opening 101A.

The pressure control chamber 110 is provided adjacent to the negative pressure chamber 101 that is the supply chamber. The pressure control chamber 110 includes a space connected to an ink injection part 100A that is opened/closed by the valve member 105.

The pressure control chamber 110 is a part of a supply path through which ink in the main tank flows toward the negative pressure chamber 101 through the tube 19. Inside the pressure control chamber 110, there is a mechanism for mitigating changes in the liquid pressure in the supply path. In particular, this mechanism is for reducing increased liquid pressure, so that the increased liquid pressure does not needlessly open the valve member 105.

The reason for reducing the increased liquid pressure is described below.

The tube 19 is filled with ink from the ink cartridge 11. When the valve member 105 is opened, the ink in the tube 19 flows into the negative pressure chamber 101. When the ink inside the tube 19 moves due to inertia caused when the carriage 14 moves or stops, the liquid pressure in the supply path may increase.

If the liquid pressure in the supply path becomes greater than or equal to the static pressure of the valve member 105, the valve member 105 opens. Consequently, an excessive amount of ink flows into the negative pressure chamber 101, and the ink pours out toward the nozzle and drops out of the sub tank 15.

In an embodiment of the present invention, when the liquid pressure increases in the pressure control chamber 110, the increased liquid pressure is reduced by changing the volume of the pressure control chamber 110 with the increased liquid pressure, and by reducing the speed of the ink moving in the pressure control chamber 110.

A description is given of a configuration for mitigating a pressure increase in the sub tank 15.

As shown in FIGS. 2A and 2B, in the pressure control chamber 110, the ink injection part 100A connected to the negative pressure chamber 101 is usually closed by the valve member 105. Near the ink injection part 100A, a pressure resistor 112 made of mesh is placed in such a manner as to extend across the ink flow direction. Furthermore, volume changing members 113 and 114 are provided near the pressure resistor 112, at least at a position downstream the ink flown direction. In the structure shown in FIGS. 2A and 2B, the volume changing members 113 and 114 are respectively provided at an upstream position and a downstream position of the ink flowing direction, with the pressure resistor 112 positioned therebetween. In the structure shown in FIGS. 2A and 2B, diaphragms having valves are used as the volume changing members 113 and 114.

The volume changing members 113 and 114 initialize the volume in the pressure control chamber 110 with the use of springs 113A and 114A. Specifically, the springs 113A and 114A contract when the negative pressure inside the negative pressure chamber 101 increases, i.e., when the pressure inside the pressure control chamber 110 exceeds a static pressure set in the valve member 105. When a pressure higher than the static pressure of the valve member 105 is applied inside the pressure control chamber 110, the volume changing members 113 and 114 contract and move so that the volume inside the pressure control chamber 110 is increased from the initial volume.

In the structure shown in FIGS. 2A and 2B, the valve head surface of the volume changing member 113 is positioned in a direction parallel to the ink flow direction. The valve head surface of the volume changing member 114 is positioned in a direction orthogonal to the ink flow direction. Accordingly, the pressure of ink that is held back by the pressure resistor 112 is effectively applied to the space where the volume changing member 113 is positioned. Furthermore, the pressure of the ink, which passes through the pressure resistor 112 and flows into the pressure control chamber 110, is directly applied to the space where the volume changing member 114 is positioned. Accordingly, the volume changing members 113 and 114 can contract with high sensitivity.

The present embodiment has the above configuration, and therefore the following functions are achieved. As shown in FIG. 2A, the volume in the pressure control chamber 110 is initialized when the liquid pressure in the ink supply path extending to the ink cartridge 11 does not reach a valve opening pressure (the pressure at which the valve member 105 opens). In this sate, the valve member 105 is maintained at static pressure, and therefore the ink injection part 100A is closed.

Meanwhile, when the liquid pressure in the ink supply path increases and becomes greater than or equal to the valve opening pressure of the valve member 105, as shown in FIG. 2B, the volume changing members 113 and 114 contract and move due to the pressure of the ink flowing inside the pressure control chamber 110.

The contraction/movement is most significant with respect to the volume changing member 113 that is positioned on the upstream side of the pressure resistor 112 in the ink flowing direction. Therefore, the pressure on the ink is reduced, and the ink passes through the pressure resistor 112.

The speed of the ink is reduced when passing through the pressure resistor 112, due to the resistance caused when the ink passes through the pressure resistor 112. After the ink has passed through the pressure resistor 112, the pressure of the ink is reduced compared to that before passing through the pressure resistor 112.

The pressure of the ink that has passed through the pressure resistor 112 is reduced as the speed of the ink is reduced when passing through the pressure resistor 112. When the pressure of the ink is higher than the static pressure of the valve member 105, the volume changing member 114 contracts and moves. As the volume changing member 114 contracts and moves, the volume of the pressure control chamber 110 increases. Therefore, by the time the ink reaches the ink injection part 100A, the pressure of the ink is reduced to the static pressure of the valve member 105. In FIGS. 2A and 2B, the reference numerals P, P1, P2, and P3 indicate a supply pressure and pressures that are applied to the respective parts, and the reference numeral P' indicates static pressure.

As described above, the pressure inside the pressure control chamber 110 is prevented from increasing excessively with the volume changing mechanism and the speed reduction mechanism.

Next, a description is given of another configuration for mitigating excessive increases in the pressure.

Figure 3:
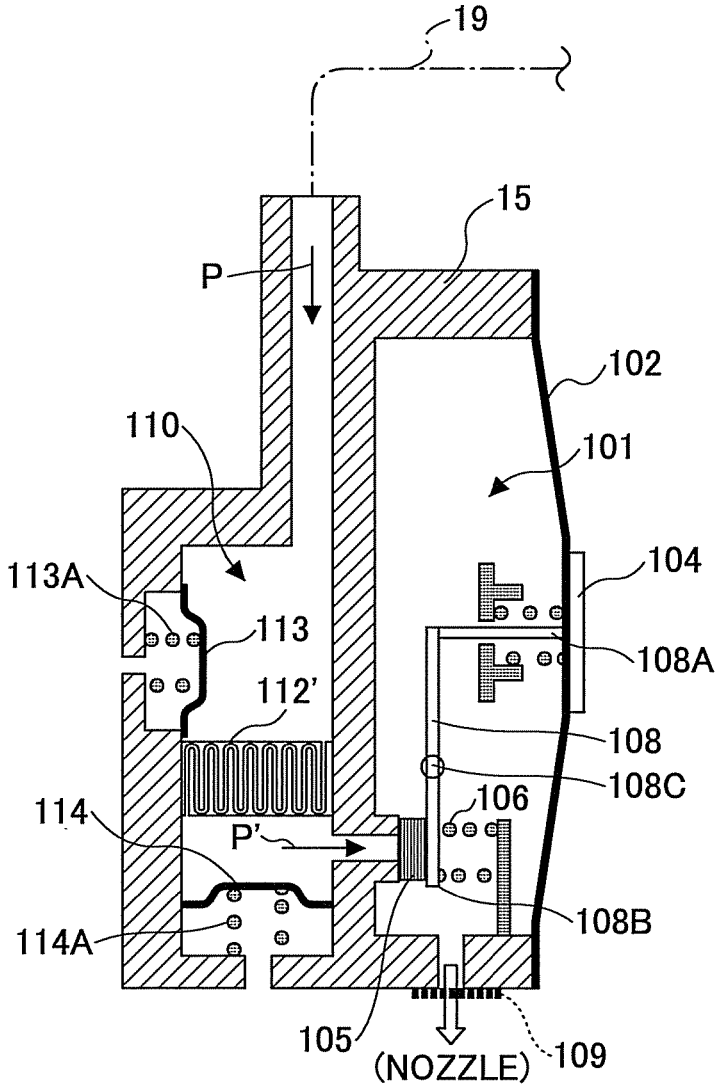
FIG. 3 illustrates a modification of the relevant parts shown in FIGS. 2A and 2B.

FIG. 3 illustrates a configuration that is different from that of FIG. 2 in that the pressure resistor in the pressure control chamber 110 has a different configuration.

In FIG. 3, a pressure resistor 112' is not a mesh type member, but a member in which a maze is formed. With this configuration, by causing the ink to flow through the pressure resistor 112', the speed of the ink can be reduced even more effectively than the case of using the mesh type pressure resistor 112. Consequently, with the configuration shown in FIG. 3, the pressure can be reduced even more effectively.

Next, a description is given of another example for mitigating excessive increases in the pressure.

Figure 4:
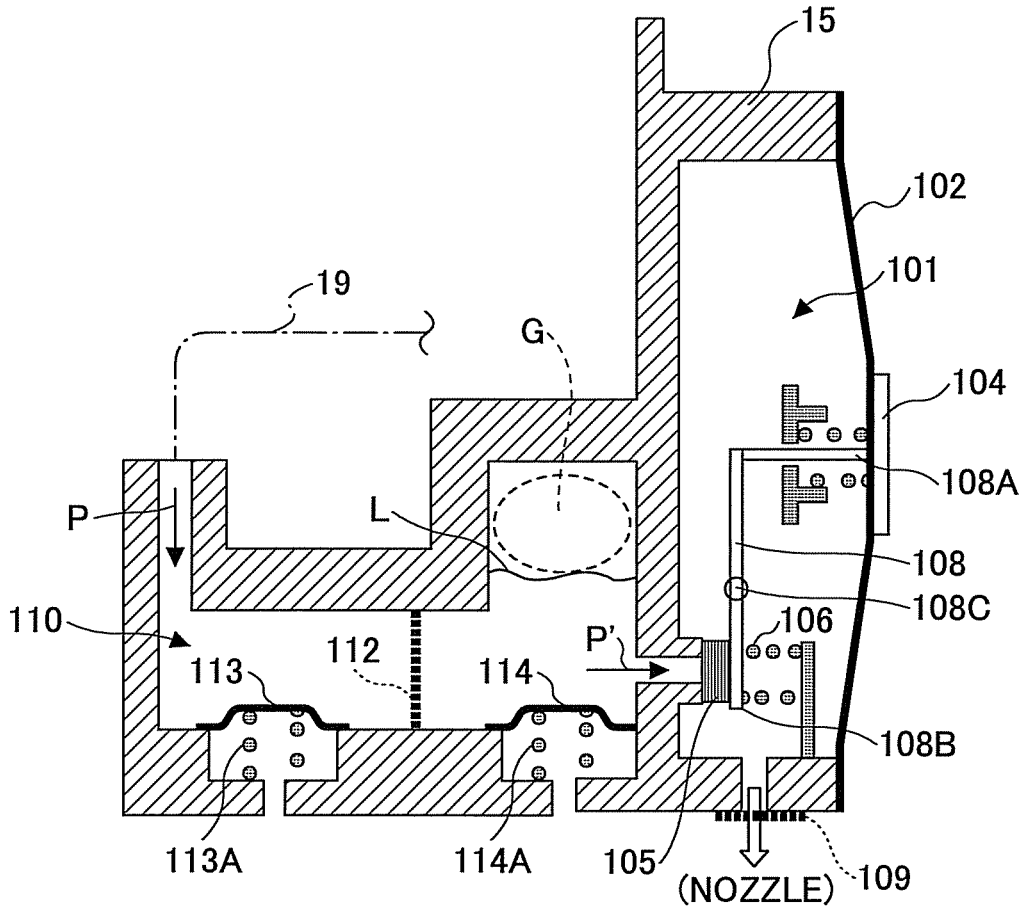
FIG. 4 illustrates another modification of the relevant parts shown in FIGS. 2A and 2B.

FIG. 4 illustrates a configuration for changing the volume of the pressure control chamber 110 with the use of expansion/contraction of gas in the space inside the pressure control chamber 110, in addition to the diaphragm configuration shown in FIG. 3.

In FIG. 4, the valve head surfaces of the volume changing members 113 and 114 are positioned in a direction parallel to the ink flow direction. In a space including the volume changing member 114 into which the ink flows after passing through the pressure resistor 112, there is provided a small amount of gas G that can expand/contract, such as air or inert gas.

In the above configuration, when the pressure of ink that has passed through the pressure resistor 112 is still higher than the static pressure, the increased pressure is consumed for expanding the volume of the pressure control chamber 110 by using the volume changing member 114 and contracting the gas G. Therefore, it is possible to mitigate the impact of the increased pressure applied on the ink injection part 100A. A sufficient amount of gas G is included in this space such that the gas G can contract, so that the liquid pressure of ink that has passed through the pressure resistor 112 can be reduced to static pressure, in combination with the function of expanding the volume of the space with the volume changing member 114.

Next, a description is given of a modification of a configuration for changing the volume of the space in the pressure control chamber 110.

Figure 5:
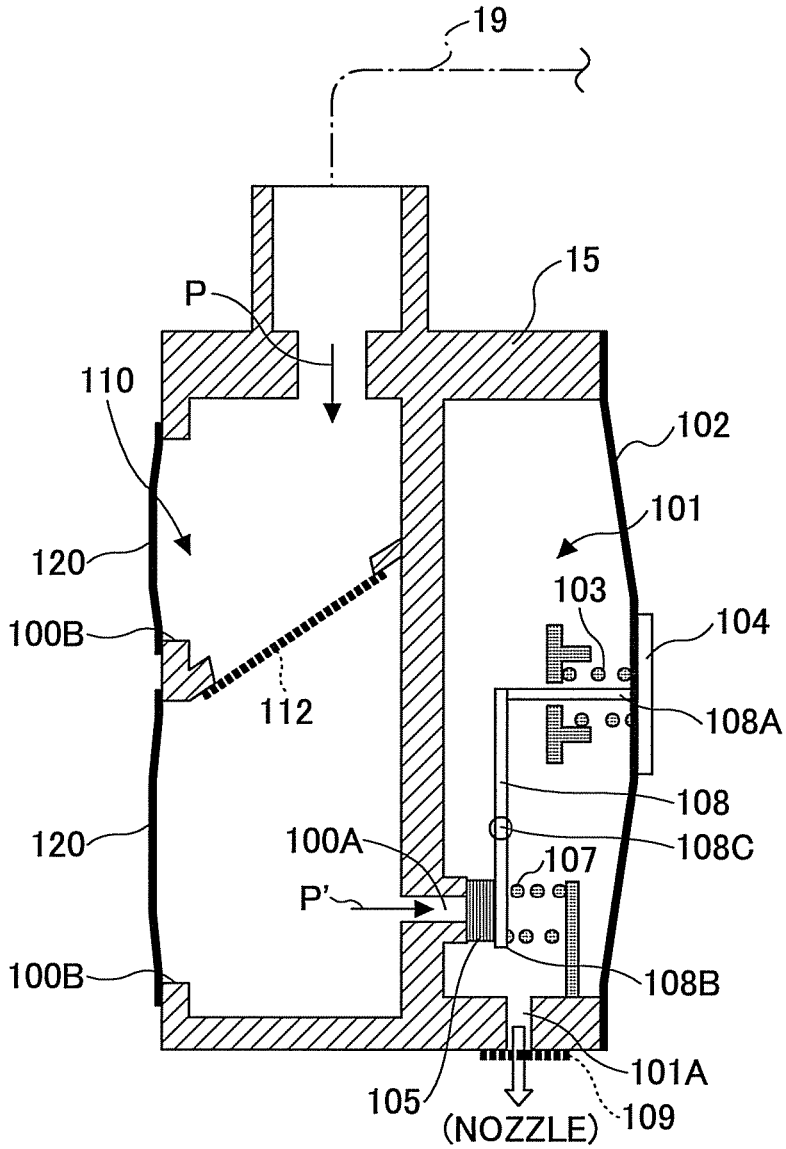
FIG. 5 is a schematic diagram of a volume changing structure in the relevant parts shown in FIGS. 2A and 2B.
Figure 6:
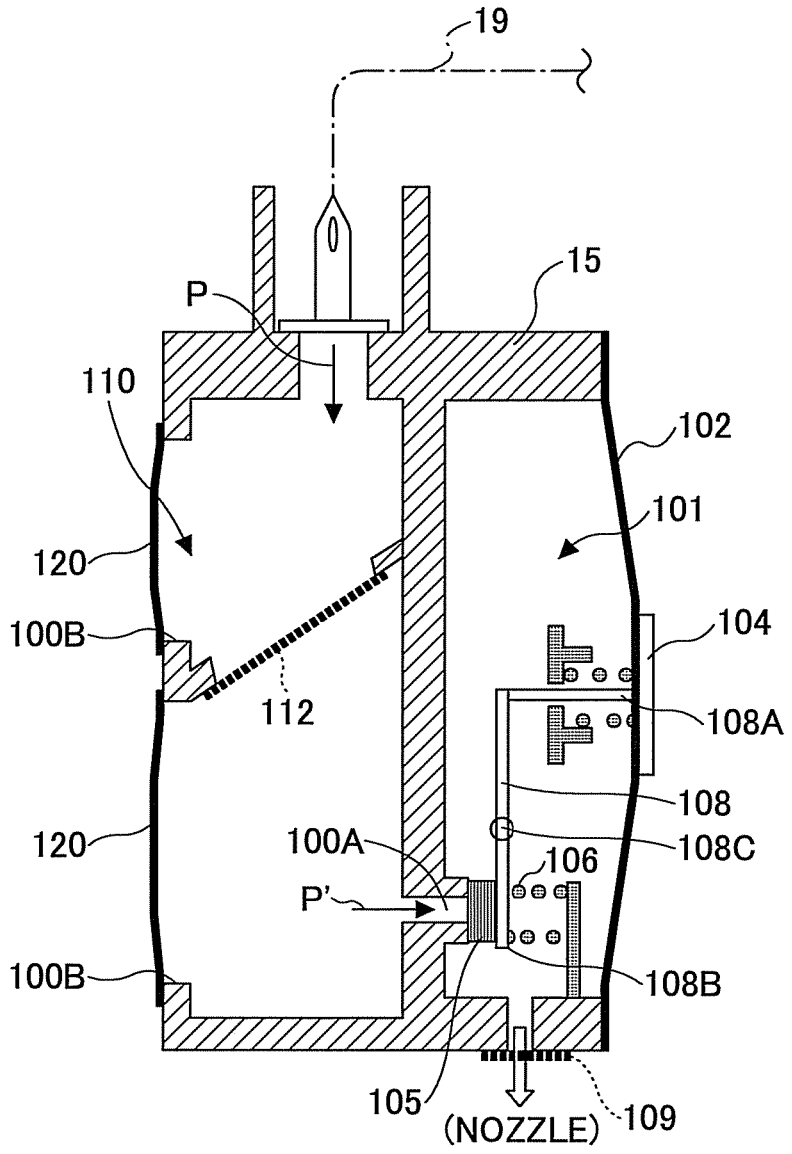
FIG. 6 is a schematic diagram of another example of the volume changing structure shown in FIG. 5.
Figure 7:
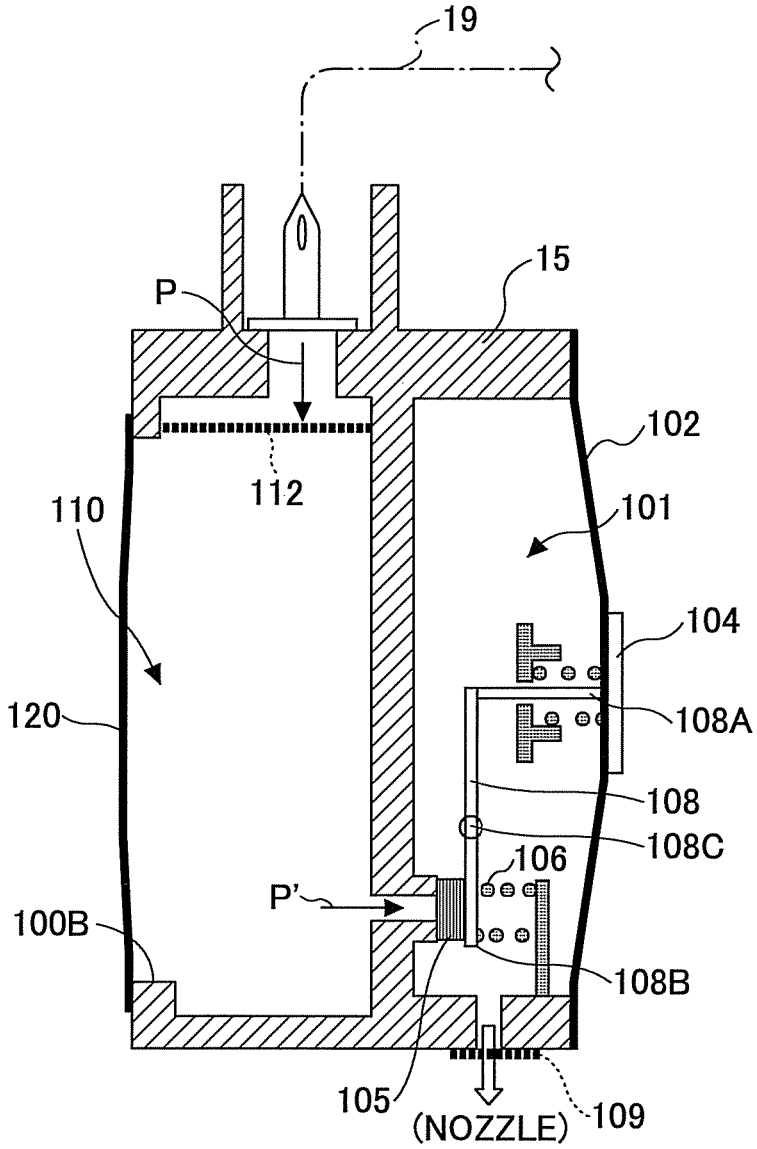
FIG. 7 is a schematic diagram of yet another example of the volume changing structure shown in FIG. 5.

FIGS. 5 through 7 illustrate configurations in which a part of the wall of the pressure control chamber 110 is used as the volume changing member.

In the FIG. 5, openings 100B are formed in the wall of the pressure control chamber 110 facing the ink injection part 100A. The openings 100B are covered by elastic films 120 made of elastic bodies such as rubber.

In the configuration of FIG. 5, the openings 100B are formed at positions corresponding to the upstream side and the downstream side of the pressure resistor 112 in the ink flow direction.

In the configuration of FIG. 6, only a single opening 100B is formed, and the elastic film 120 is covering the single opening 100B. In the configuration of FIG. 6, a supply needle is provided at the ink supply unit of the pressure control chamber 110. Therefore, when an ink cartridge (not shown) is directly attached to the sub tank, a sealing film provided at the supply opening of the ink cartridge can be ripped open with the supply needle so that ink can flow out.

FIG. 7 is formed by partially modifying the configuration of FIG. 6. In the configuration of FIG. 7, the pressure resistor 112 is positioned at the connection part between the sub tank 15 and the tube 19.

In any case, the elastic film 120 (volume changing member) is provided near the ink injection part 100A on the downstream side of the pressure resistor 112 in the ink flow direction. Therefore, it is possible to mitigate the impact of the increased pressure applied on the ink injection part 100A.

FIGS. 8A through 9B illustrate the sub tank 15 including the elastic film 120 of FIGS. 5 through 7. FIGS. 8A through 9B illustrate a state where the cover covering the surface of the pressure control chamber 110 is removed.

Figure 8A:
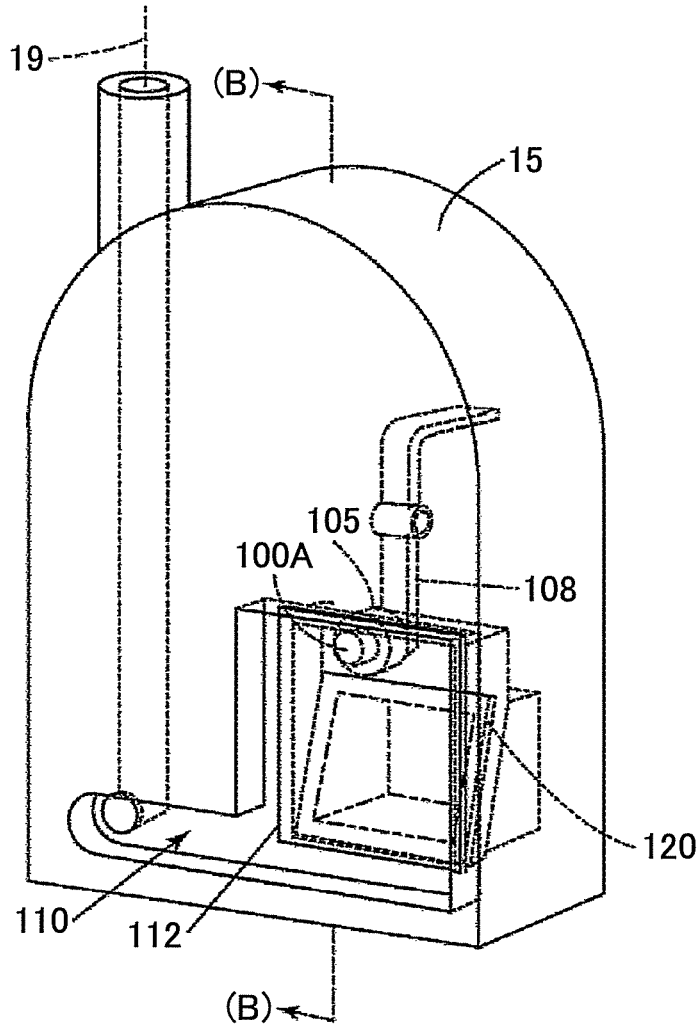
FIGS. 8A and 8B illustrate a sub tank including the relevant parts shown in FIGS. 2A and 2B.
Figure 8B:
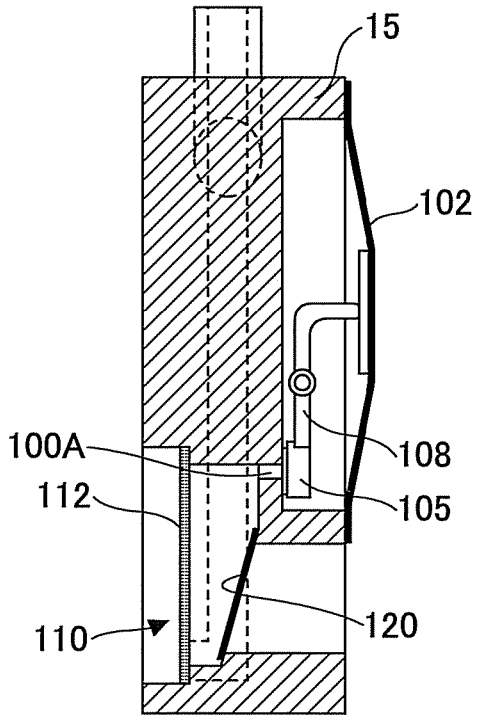

In the configuration of FIGS. 8A and 8B, the elastic film 120 is provided at a position where ink supplied from the tube 19 into the pressure control chamber 110 has passed through the pressure resistor 112. The ink injection part 100A is provided in the space formed by the elastic film 120 and the pressure resistor 112.

Figure 9A:
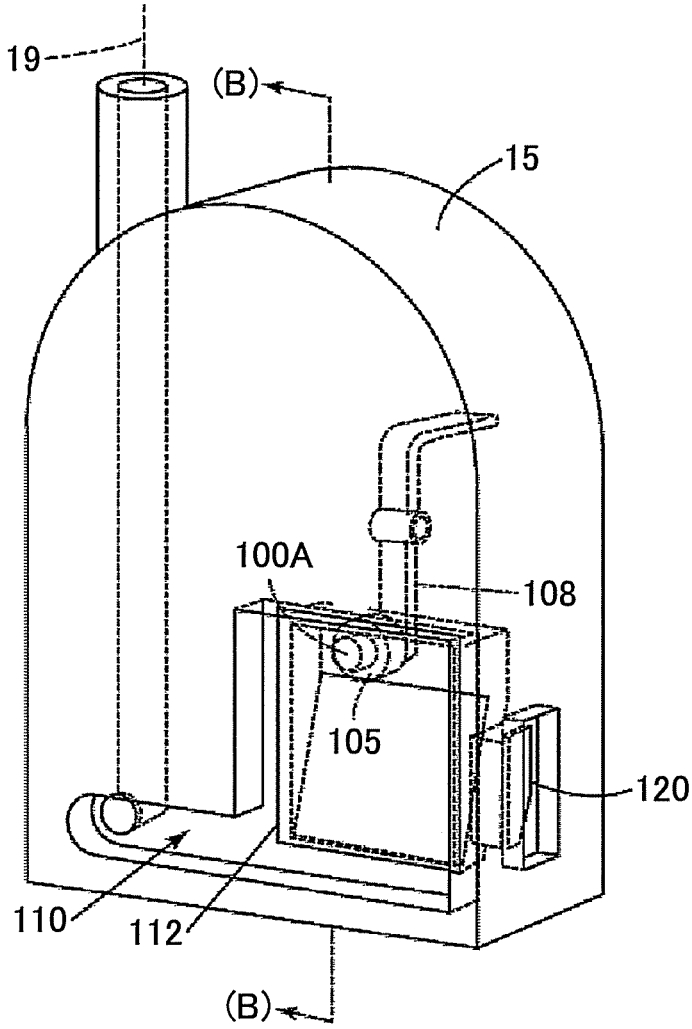
FIGS. 9A and 9B illustrate a modification of the sub tank shown in FIGS. 8A and 8B.
Figure 9B:
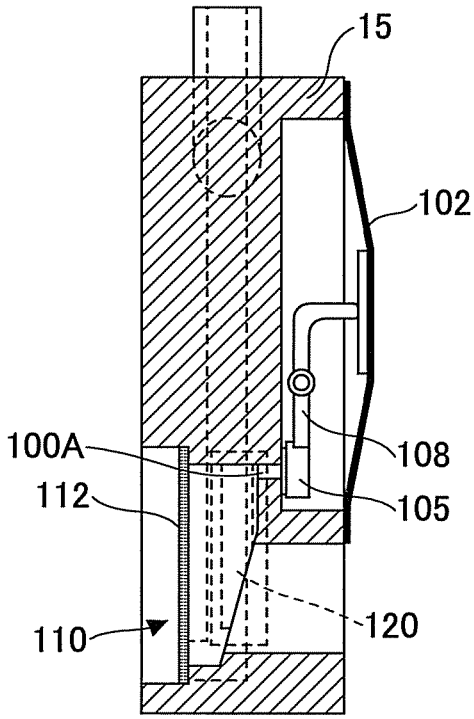

The configuration of FIGS. 9A and 9B is different from that of FIGS. 8A and 8B in that the elastic film 120 is provided on the side surface of the space positioned beyond the pressure resistor 112 in the ink flow direction. With this configuration, the thickness of the sub tank 15 can be made thinner than that of the configuration of FIGS. 8A and 8B.

With the above configurations, when the pressure in the pressure control chamber 110 becomes greater than or equal to the static pressure, the elastic film 120 expands and deforms so that the volume inside the pressure control chamber 110 increases and the pressure can be reduced. Therefore, it is possible to mitigate the impact of the increased ink pressure applied on the valve member 105 that is closing the ink injection part 100A.

The present invention is not limited to the specific embodiments described herein, and variations and modifications may be made without departing from the scope of the present invention.

The present application is based on Japanese Priority Patent Application No. 2010-001964, filed on Jan. 7, 2010, the entire contents of which are hereby incorporated herein by reference.

What is claimed is:

1. A liquid jetting device comprising:

a main tank that stores a recording liquid;

a sub tank that is connected to the main tank via a supply path, the recording liquid being supplied into the sub tank from the main tank by a predetermined pressure applied to the main tank; and an inkjet head having a nozzle that jets the recording liquid retained in the sub tank, wherein the sub tank includes a supply chamber that stores the recording liquid to be supplied to the nozzle, and a pressure control chamber that supplies the recording liquid from the main tank into the supply chamber, the pressure control chamber being connected to the supply path, and wherein the supply chamber includes a flexible member that is expanded outwardly by a spring and is deformed due to a negative pressure generated in the supply chamber by the jetting operation of the ink head, and a valve provided at a supply opening through which the recording liquid enters the supply chamber from the pressure control chamber, the valve being configured to open and close the supply opening according to the deformation of the flexible member, and wherein the pressure control chamber includes a pressure resistor having a filter function provided near the supply opening, the pressure resistor being placed in such a manner as to extend across a flow direction of the recording liquid, and a volume changing member provided on an outside wall of the sub tank on a pressure control chamber side near the supply opening, on at least a downstream side with respect to the pressure resistor in the flow direction of the recording liquid, the volume changing member facing an outside of the sub tank and being deformable in a direction such that a volume of the pressure control chamber increases when the pressure control chamber receives a pressure that is higher than a pressure in the supply chamber, wherein the volume changing member includes a first volume changing unit disposed on an upstream side with respect to the pressure resistor in the flow direction of the recording liquid and a second volume changing unit disposed on the downstream side with respect to the pressure resistor in the flow direction of the recording liquid.

2. The liquid jetting device according to claim 1, wherein the volume changing member includes a diaphragm mechanism that is displaced in a direction such that the volume of the pressure control chamber increases, the diaphragm mechanism being displaced by a pressure that is higher than the pressure in the supply chamber.

3. The liquid jetting device according to claim 1, wherein the volume changing member includes an elastic body that is elastic so as to he displaced in a direction such that the volume of the pressure control chamber increases, the elastic body being displaced by a pressure that is higher than the pressure in the supply chamber, and a valve that forms a part of the outside wall of the sub tank on the pressure control chamber side, the valve being integrally combined with the elastic body.

4. The liquid jetting device according to claim 1, wherein the pressure resistor includes a path having maze structure.

5. An image forming apparatus comprising the liquid jetting device according to claim 1.

6. The liquid jetting device according to claim 1, wherein the volume changing member includes a spring member configured to contract when the pressure control chamber receives a pressure that is higher than the pressure in the supply chamber.

7. The liquid jetting device according to claim 1, wherein the supply opening between the pressure control chamber and the supply chamber is formed on a wall between the pressure control chamber and the supply chamber and across the pressure control chamber from the outside wall of the sub tank on which the volume changing member is provided.

8. The liquid jetting device according to claim 1, wherein the volume changing member includes a top surface that is parallel to a flow direction of the recording liquid through the supply opening between the pressure control chamber and the supply chamber.

9. The liquid jetting device according to claim 1, wherein the outside wall on which the volume changing member is provided is adjacent to a side wall on which the supply opening is formed.

10. The liquid jetting device according to claim 1, wherein the volume changing member has a top surface that is perpendicular to the pressure resistor.

* * * * *